US009095486B2

(12) United States Patent
Matsubara et al.

(10) Patent No.: US 9,095,486 B2
(45) Date of Patent: Aug. 4, 2015

(54) INFANT INCUBATOR

(71) Applicant: ATOM MEDICAL CORPORATION, Bunkyo-ku, Tokyo (JP)

(72) Inventors: Kazuo Matsubara, Tokyo (JP); Terumi Matsubara, Saitama (JP); Shinichi Kobayashi, Saitama (JP); Kenji Kobayashi, Saitama (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 157 days.

(21) Appl. No.: 13/872,747

(22) Filed: Apr. 29, 2013

(65) Prior Publication Data

US 2013/0310634 A1 Nov. 21, 2013

(30) Foreign Application Priority Data

May 15, 2012 (JP) ..... 2012-111526

(51) Int. Cl.
*A61G 11/00* (2006.01)

(52) U.S. Cl.
CPC ..... *A61G 11/003* (2013.01); *A61G 11/002* (2013.01); *A61G 11/008* (2013.01); *A61G 11/009* (2013.01); *A61G 11/006* (2013.01)

(58) Field of Classification Search
CPC ... A61G 11/00; A61G 11/001; A61G 11/002; A61G 11/003; A61G 11/005; A61G 11/006; A61G 11/008; A61G 11/009; A61G 7/1046; A61G 7/005; A61G 2203/80
USPC ..... 600/22
See application file for complete search history.

(56) References Cited

U.S. PATENT DOCUMENTS

2010/0286471 A1* 11/2010 Matsubara et al. ..... 600/22

FOREIGN PATENT DOCUMENTS

JP 2010-082325 A 4/2010
JP 2010-259651 A 11/2010

* cited by examiner

*Primary Examiner* — Christine H Matthews
(74) *Attorney, Agent, or Firm* — Arent Fox LLP

(57) ABSTRACT

An infant incubator including: a bed of an infant; a first supporting-shaft disposed obliquely above the bed, extends substantially horizontally, and rotatable back and forth at a predetermined extent around an axis; a rotation stay fixed to and rotated with the first supporting-shaft; a second supporting-shaft provided with the rotation stay and parallel to the first supporting-shaft; and a heater disposed obliquely above the bed, attached to the rotation stay rotatably back and forth at a predetermined extent around the second supporting-shaft, and configured to emit a heat ray obliquely to an upper surface of the bed, wherein a position of the heater can be varied between a heating position for emitting the heat ray and a folding position for moving away from above the bed; and at the heating position, an emission angle of the heat ray from the heater is further varied.

2 Claims, 12 Drawing Sheets

INFANT INCUBATOR

BACKGROUND OF THE INVENTION

1. Field of the Invention

The present invention relates to an infant incubator.

Priority is claimed on Japanese Patent Application No. 2012-111526, filed May 15, 2012, the content of which is incorporated herein by reference.

2. Description of Related Art

For an infant incubator to provide a suitable physiological environment for a premature infant, an infant mattress for laying the infant and a heater for emitting heat ray to an upper surface of the infant mattress are equipped.

For example, an infant incubator disclosed in Unexamined Japanese Patent Application, First Publication No. 2010-82325 has a heater which can heat all the upper surface of the infant mattress substantially evenly even though being arranged at a deviated position from above the infant mattress. This infant incubator enables the infant to be nursed or treated as reliably heating the infant even though the infant is laid on anywhere of the upper surface of the infant mattress since the heater is not arranged immediately above the infant mattress so that the heater does not cumber for operating radiography or treating the infant.

Also, Unexamined Japanese Patent Application, First Publication No. 2010-259651 discloses a heater which can be stowed so as not to prevent a top hood from elevating for a combination infant incubator as an open-type and a closed-type.

SUMMARY OF THE INVENTION

Problems to be Solved by the Invention

According to the heater provided with the infant incubator disclosed in Unexamined Japanese Patent Application, First Publication No. 2010-82325, it is possible to heat the area on the infant mattress broadly and substantially evenly without preventing radiography or treatment. However, since the heater is not arranged immediately above the infant mattress, an emission angle of the heat ray from the heater with respect to the upper surface of the infant mattress is acute as distant from the heater, so that an emission area narrows vertically. Therefore, in a case in which a head of the infant is not arranged near the heater, the emission area of the heat ray is deviated from the head of the infant with height-distance from the upper surface of the mattress, and the head of the infant may not be heated.

The present invention is achieved in consideration of the above circumstances, and has an object to provide an infant incubator having a heater in which treatments or examinations for an infant is not prevented, a suitable temperature environment can be provided for an infant laid anywhere on a mattress, and an operator is scarcely affected by heat.

Means for Solving the Problem

An infant incubator according to the present invention has: a bed on which an infant is laid; a first supporting-shaft which is disposed at obliquely above the bed, extends substantially horizontally, and is rotatable back and forth at a predetermined extent around an axis; a rotation stay which is fixed to the first supporting-shaft and is rotated with the first supporting-shaft; a second supporting-shaft which is provided with the rotation stay and substantially parallel to the first supporting-shaft; and a heater which is disposed at obliquely above the bed, supported to the rotation stay rotatably back and forth at a predetermined extent around the second supporting-shaft, and possible to emit heat ray obliquely to an upper surface of the bed. In this infant incubator, by rotating the rotation stay back and forth around the first supporting-shaft at the predetermined extent, the heater is moved along with the rotation stay, so that a position of the heater can be varied between a heating position for emitting the heat ray and a folding position for moving away from above the bed; and at the heating position, by rotating the heater back and forth around the second supporting-shaft with respect to the rotation stay at the predetermined extent, an emission angle the heat ray from of the heater can be further varied.

In a case in which the heater is disposed obliquely above the bed, the heat ray is emitted obliquely to the bed, so that the emission area of the heat ray narrows vertically as distant from the heater. On the other hand, according to the infant incubator of the present invention, by further rotating the heater at the heating position, the emission angle of the heat ray can be adjusted. Therefore, even when a part of a body of the infant is receded from the emission area of the heat ray, the angle of the heater can be adjusted so that whole body of the infant is in the emission area of the heat ray.

The infant incubator of the present invention is preferable to further have: a link member which is connected to and rotated with the first supporting-shaft; and a rod which is engaged with the link member and extends substantially vertically, so that by rotating the link member back and forth at the predetermined extent along with up- and down motion of the rod, the rotation stay is rotated back and forth with the first supporting-shaft at the predetermined extent.

By utilizing a linkage mechanism for rotating the heater, a structure at a periphery of the heater can be simplified, for example, by disposing a driving part below the bed but not the periphery of the heater. However, the linkage mechanism may limit a rotation extent of the heater, so that it is hard to adjust the emission angle of the heat ray at the heating position. On the other hand, according to the infant incubator of the present invention, a mechanism is provided for rotating the heater back and forth at a predetermined extent with respect to the rotation stay other than the linkage mechanism for rotating the rotation stay, so that it is easy to adjust the emission angle of the heat ray.

Effects of the Invention

According to the present invention, an infant incubator can be obtained to have a heater which does not interfere operations or examinations for an infant, which can provide an appropriate temperature environment for the infant laid on any position on a mattress, and in which an influence of heat is small to an operator.

DESCRIPTION OF THE PREFERRED EMBODIMENTS

Figure 1:
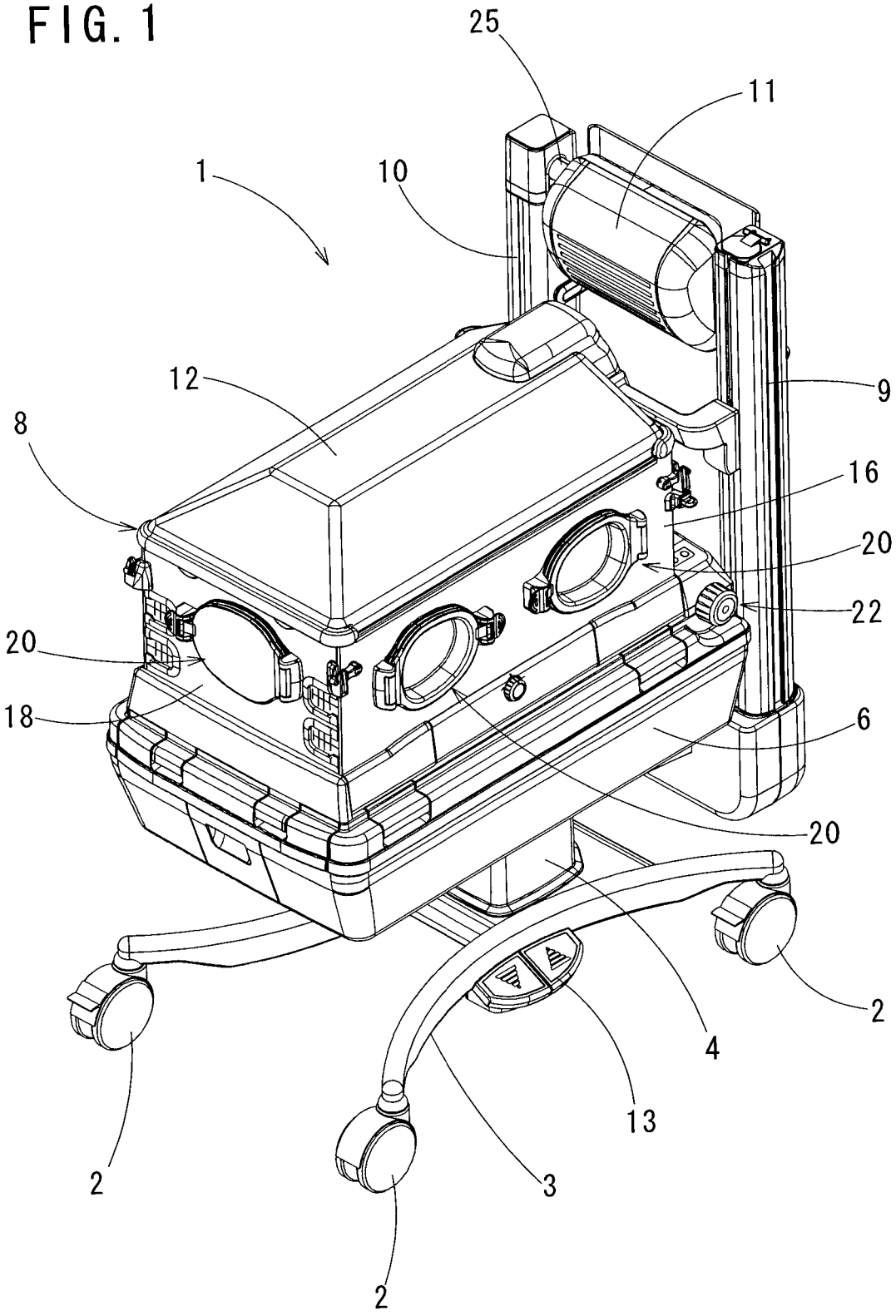
FIG. 1 is a perspective view showing an infant incubator (in a closed-state) according to an embodiment of the present invention.

Hereinafter, an embodiment of an infant incubator according to the present invention will be described. An infant incubator 1 of the present invention has: a bed 14 on which an infant is laid; a first supporting-shaft 25 which is disposed at obliquely above the bed 14, extends substantially horizontally, and is rotatable back and forth at a predetermined extend around an axis; a rotation stay 29 which is fixed to the first supporting-shaft 25 and is rotated with the first supporting-shaft 25; a second supporting-shaft 33 which is provided with the rotation stay 29 and substantially parallel to the first supporting shaft 25; and a heater 11 which is disposed at obliquely above the bed 14, supported to the rotation stay 29 rotatably back and forth at a predetermined extent around the second supporting-shaft 33, and possible to emit heat ray obliquely to an upper surface of the bed 14.

As wholly shown in FIGS. 1 to 6, the infant incubator 1 is provided with: pedestal 3 which is movable by casters 2; a supporting post 4 which is vertically erected on the pedestal 3; a frame 5 which is provided at a top end of the supporting post 4; a base table 6 which is set on the frame 5; a hood 8 which is provided on the base table 6 and surrounds an infant chamber 7; a first guide-post 9 and a second guide-post 10 which are vertically provided at an end portion of the frame 5 and sides of the hood 8; the heater 11 which is provided at a top end of the second guide-post 10; and a canopy 12 which is set on a top end of the first guide-post 9 so as to form a ceiling of the hood 8. The supporting post 4 internally has a lift which moves the frame 5 up and down. A pedal 13 is provided at a side of the pedestal 3 for operating the lift.

The hood 8 is constructed substantially rectangular from: a floor plate 15 in which a bed 14 for laying the infant down is mounted; side treatment-doors 16 and 17 which are disposed each at a left side and a right side of the infant; a foot-side treatment door 18 which is disposed at a foot side of the infant; a head-side treatment-door 19 which is disposed at a head side of the infant; and the canopy 12 which closes a top of the infant chamber 7 which is surrounded by the side treatment-doors 16 and 17, the foot-side treatment-door 18 and the head-side treatment-door 19. The side treatment-doors 16 and 17, the foot-side treatment-door 18, the head-side treatment-door 19 and the canopy 12 are substantially entirely formed from transparent resin, so that the infant in the infant chamber 7 can be checked with eyes from the outside.

Figure 2:
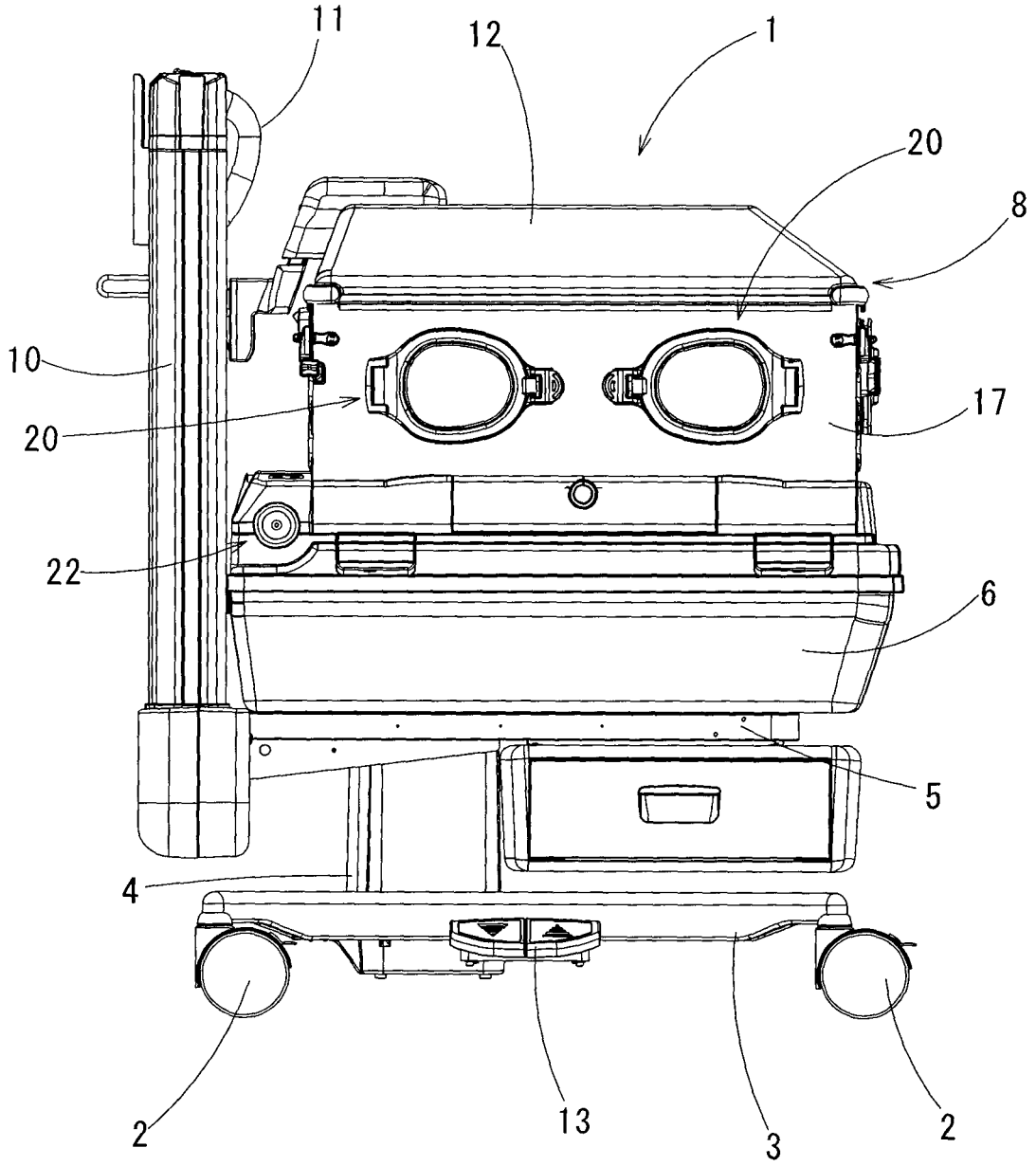
FIG. 2 is a side view showing the infant incubator of FIG. 1.
Figure 3:
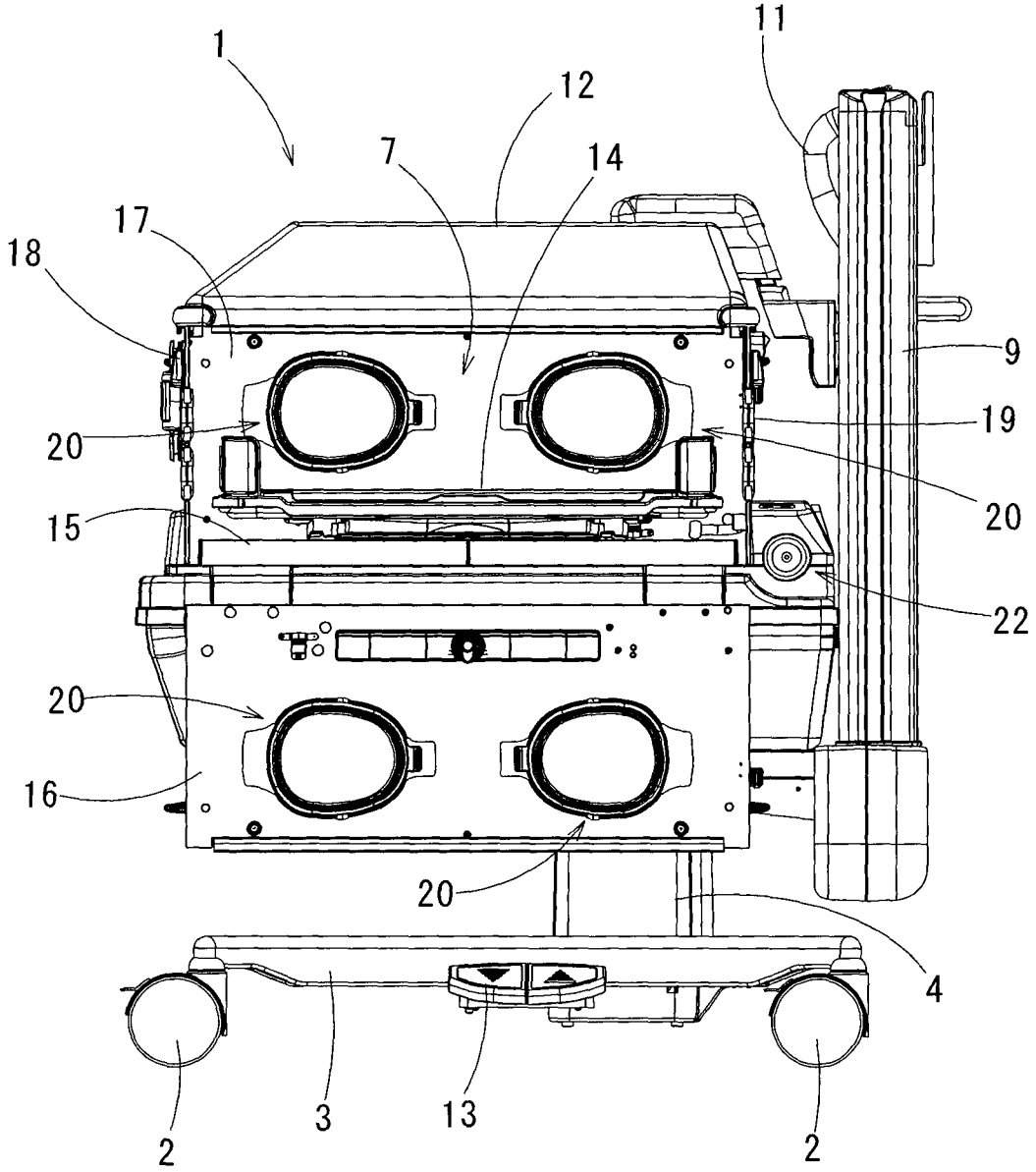
FIG. 3 is a side view showing a state in which a side-treatment-door is open in the infant incubator of FIG. 1.
Figure 4:
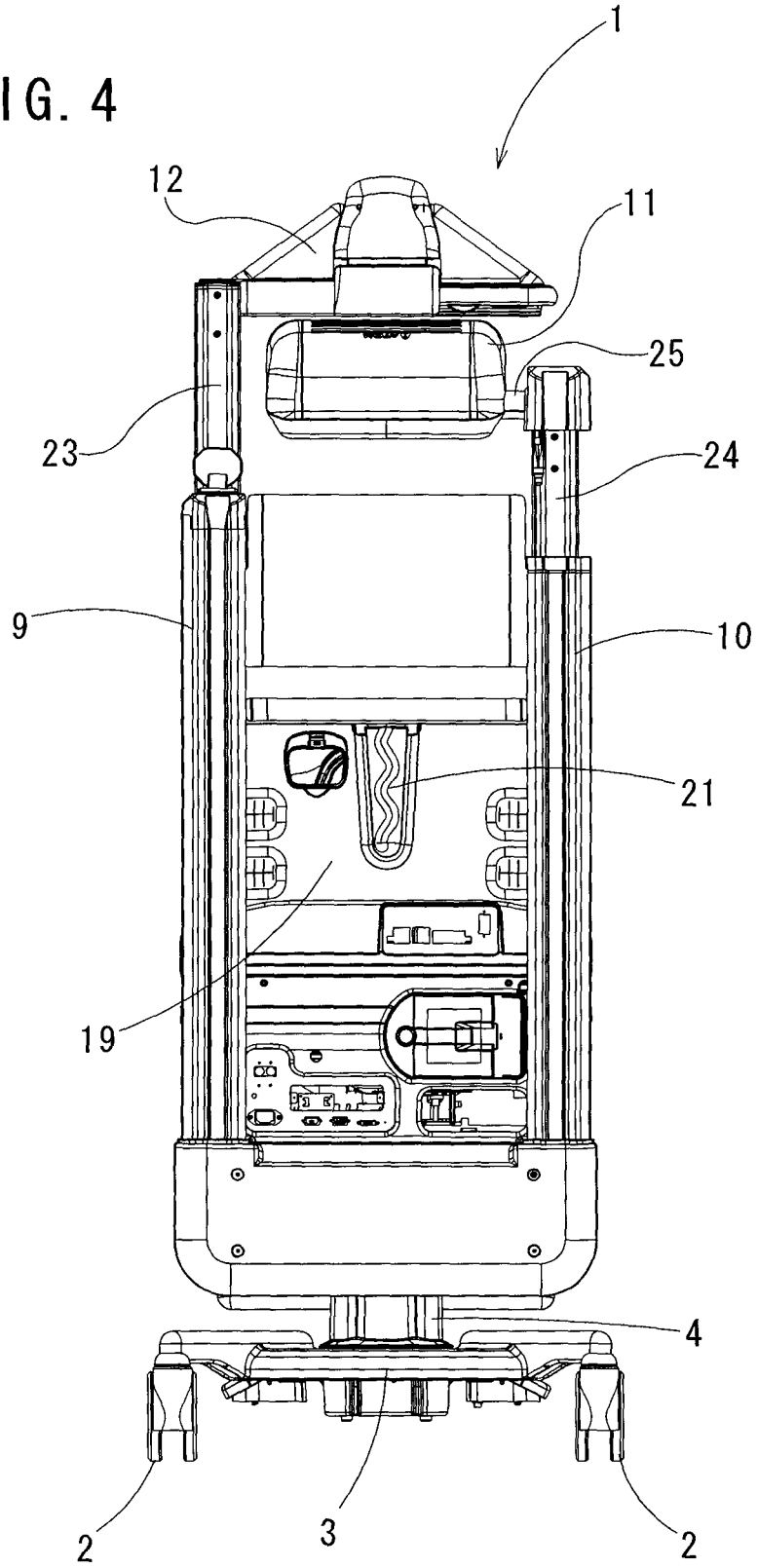
FIG. 4 is a back view showing the infant incubator (in an open-state) of FIG. 1.
Figure 5:
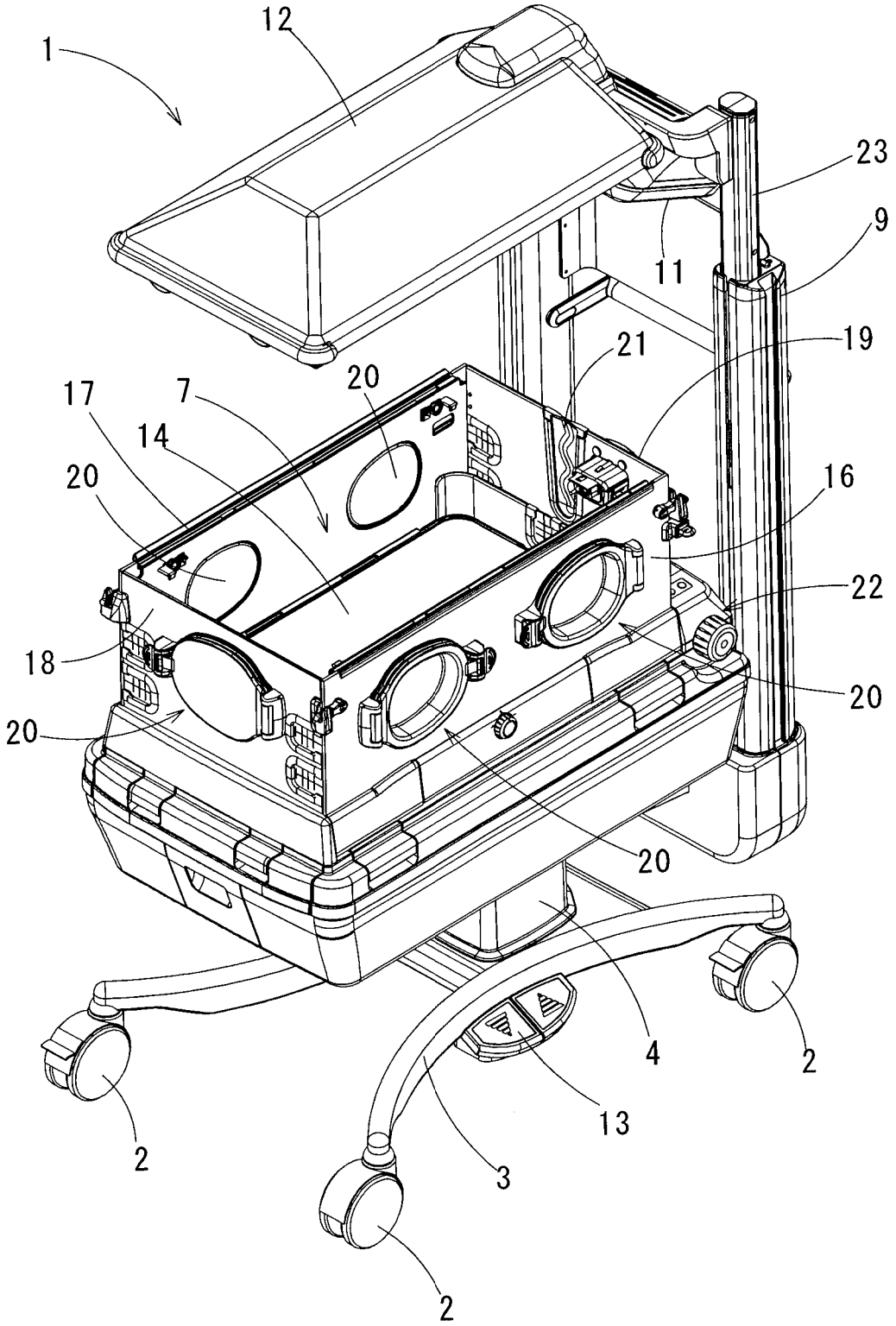
FIG. 5 is a perspective view showing the infant incubator (in the open-state) of FIG. 1.
Figure 6:
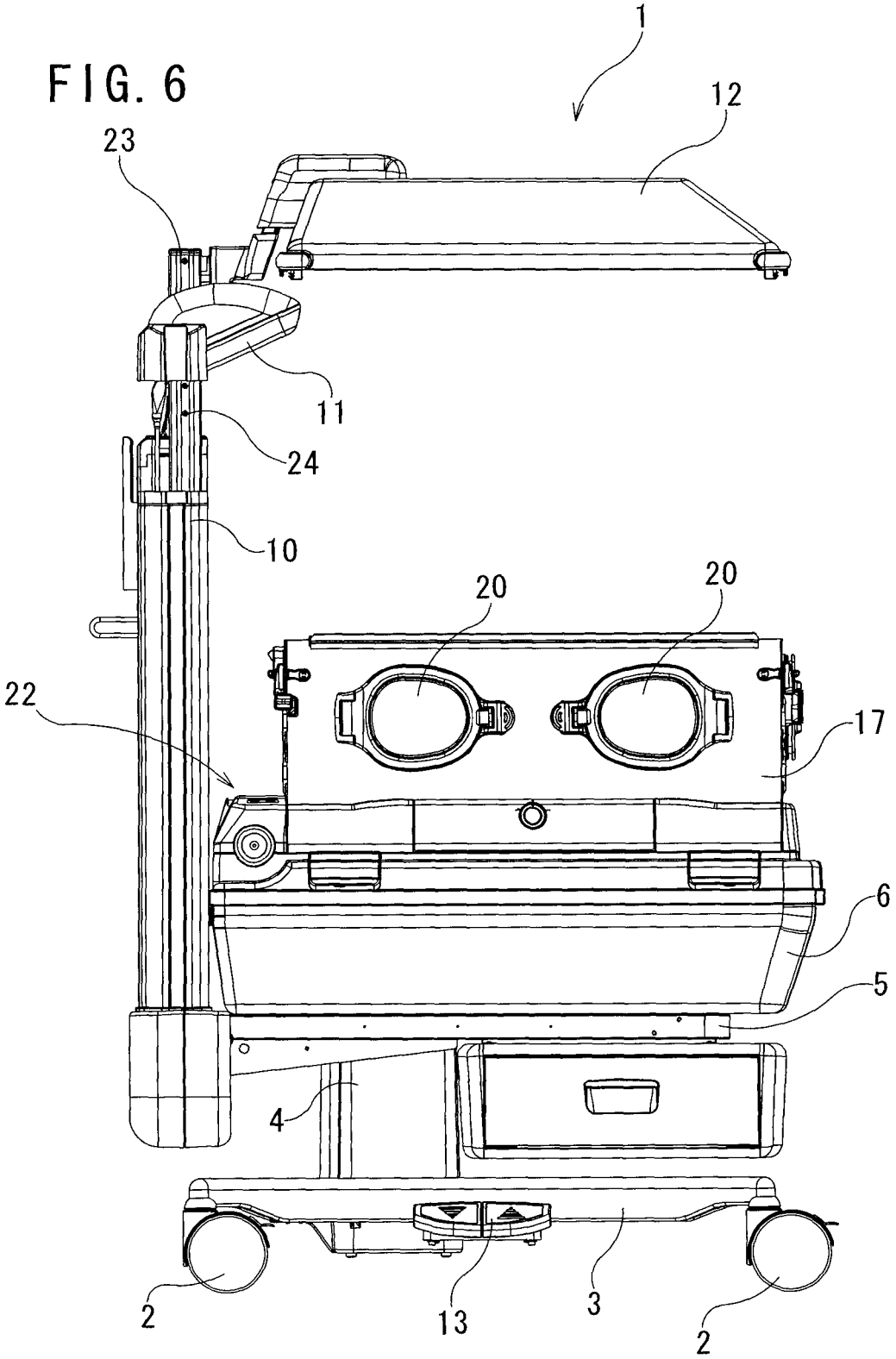
FIG. 6 is a side view showing the infant incubator (in the open-state) of FIG. 1.

FIGS. 1 to 3 show a state in which the hood 8 is closed by moving down the canopy 12; and FIGS. 4 to 6 show a state in which the top of the infant chamber 7 is open by moving up the canopy 12. Also, in FIGS. 4 to 6, the heater 11 is moved up to a heating position so as to heat the infant chamber 7. As described above, the infant incubator 1 has both the functions of forms of an enclosed incubator shown in FIGS. 1 to 3 and an open incubator shown in FIGS. 4 to 6.

Among the treatment-doors 16 to 19, the head-side treatment-door 19 is maintained in a vertical posture erecting at the head side of the infant chamber 7. On the other hand, lower ends of the side treatment-doors 16 and 17 and the foot-side treatment-door 18 are installed swingably around a horizontal shaft (not illustrated) with respect to the base table 6. In order to examine or treat the infant from various directions, by bringing one of or some of the treatment-doors 16 to 18 down, one side or three sides of the infant chamber 7 can be open. In FIG. 3, one side of the infant chamber 7 is open by turning the side treatment-door 16.

In a case in which the infant incubator 1 is used as the enclosed incubator, the canopy 12 is moved down and the treatment-doors 16 to 18 are closed. In the closed-state, the side treatment-doors 16 and 17 can be open and closed for taking care of the infant. In a case in which the infant incubator 1 is used as the open incubator, the canopy 12 is moved up and three sides of the infant chamber 7, i.e., the side treatment-doors 16 and 17 and the foot-side treatment-door 18 can be open and closed for taking care of the infant.

The side treatment-doors 16 and 17 and the foot-side treatment-door 18 have access-ports 20. When the infant incubator 1 is used as the enclosed incubator, the access ports 20 can be open and closed while the treatment-doors 16 to 18 remain standing. The head-side treatment door 19 is provided with grommet members 21 having slits through which cables or tubes are inserted as shown in FIG. 4.

On the floor plate 15 in the infant chamber 7, the bed 14 on which the infant is laid is provided. The bed 14 is swingably held at a center of a longitudinal direction by a horizontal shaft (not illustrated) and an end portion of the head side is held by a lift 22. By elevating the end portion which is held by the lift 22, the bed 14 can maintain a position which is inclined to the horizontal direction. The lift 22 is provided at an outside of the hood 8.

The first guide-post 9 has a coaxial lift-post 23 and a lift mechanism for moving up and down the lift-post 23 therein. The second guide-post 10 also has a coaxial lift-post 24 and a lift mechanism for moving up and down the lift-post 24 therein. The canopy 12 is attached to an upper end of the lift-post 23 of the first guide-post 9, can close the infant chamber 7 at a down position thereof by being in contact with upper ends of the treatment-doors 16 to 19 (shown in FIGS. 1 to 3), and can retract from the treatment-doors 16 to 19 at an enough distance for treatments for the infant at an upper position thereof (shown in FIGS. 4 to 6).

Figure 7:
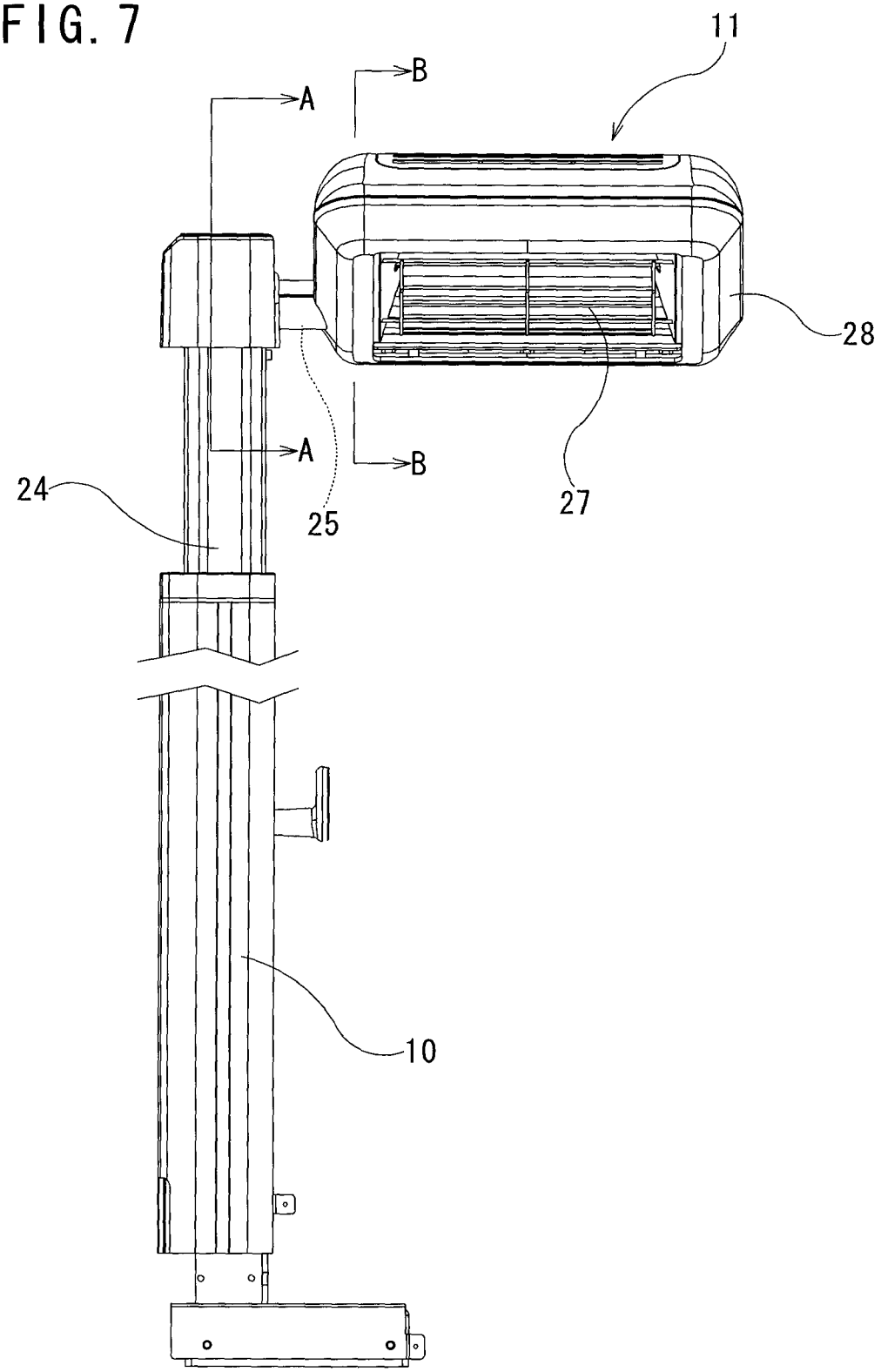
FIG. 7 is a front view showing a heater provided with the infant incubator (in a heating position) of FIG. 1.

The heater 11 is attached to an upper end of the lift-post 24 of the second guide-post 10 as shown in FIGS. 6 and 7 rotatably at a predetermined extent around the substantially horizontal first supporting-shaft 25. The heater 11 can take: a folding position by folding vertically and substantially parallel to the second guide-post 10 at a down position of the lift-post 24 as shown in FIGS. 1 to 3; and a heating position for supplying heat ray from above to the infant chamber 7 at an elevated position of the lift-post 24 by being raised with a predetermined angle with respect to the vertical direction as shown in FIGS. 4 to 7. In a state in which the heater 11 is in the folding position, the canopy 12 can be moved up and down without being prevented by the heater 11.

Figure 8:
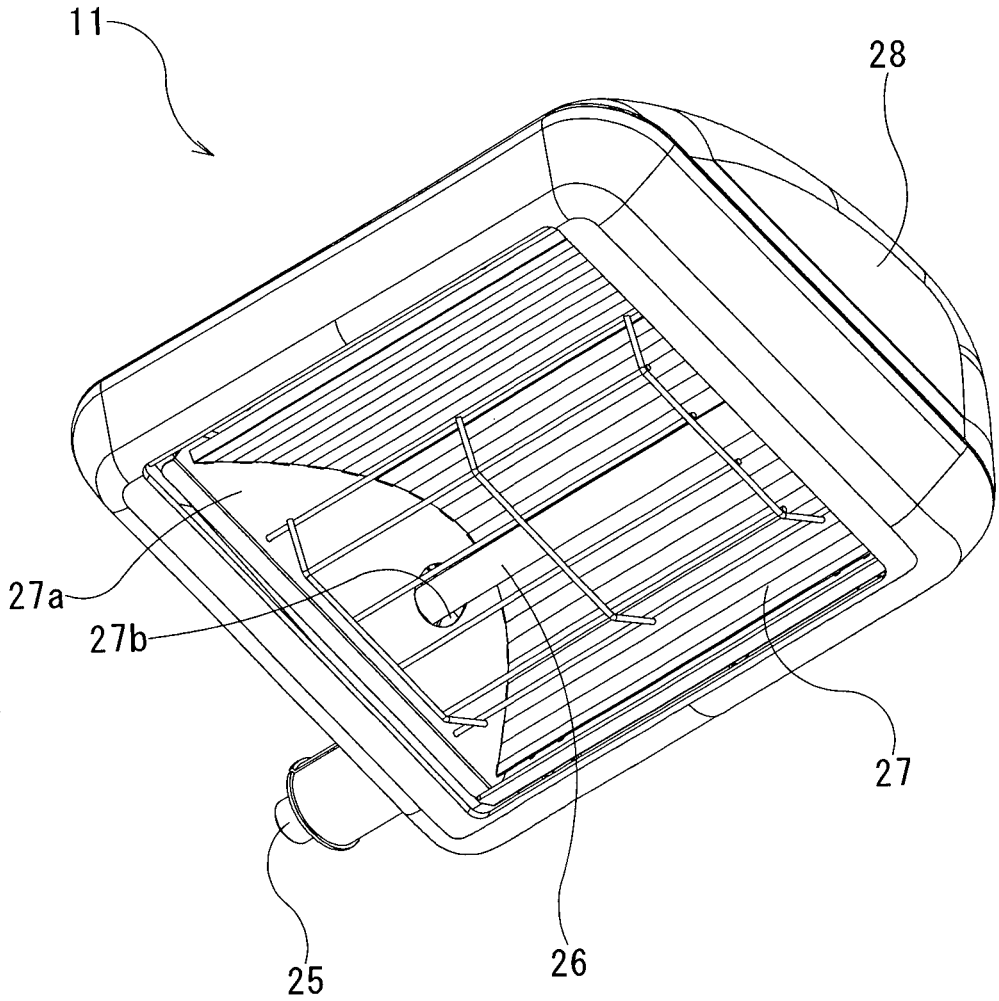
FIG. 8 is a perspective view showing the heater.
Figure 9:
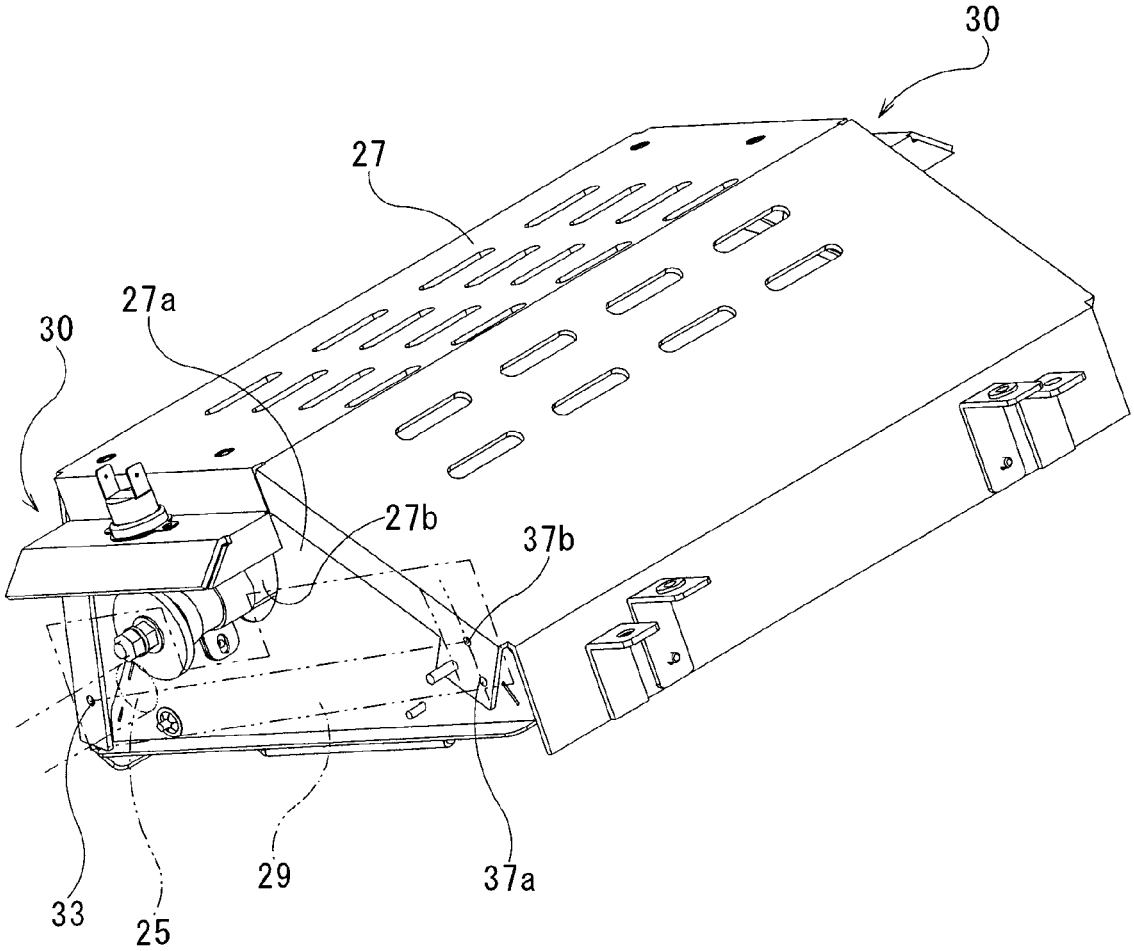
FIG. 9 is a perspective view showing a reflector forming the heater.

As shown in FIGS. 7 to 9, the heater 11 includes: a substantially rod-shape heating element 26; a reflector 27 which holds the heating element 26 so as to cover the backside thereof and reflects the heating ray of the heating element 26 toward a predetermined direction; and a reflector cover 28 which covers the backside and the lateral side of the reflector 27, and is cantilevered by the first supporting-shaft 25 by the intermediary of the rotation stay 29. As the heating element 26, a ceramics heater, a quartz heater, a stainless heater can be utilized. The reflector cover 28 is made from heat-resisting synthetic resin or the like. The reflector 27 and the reflector cover 28 are fixed with each other, and rotatable back and forth at the predetermined extent with respect to the rotation stay 29 which is arranged between the reflector 27 and the reflector cover 28 and is formed as a unit with the first supporting-shaft 25 (FIG. 9).

As shown in FIG. 8 and FIG. 9, the reflector 27 is formed in a substantially box-shape which opens downward by a bending process of metallic plate, and is stowed in the reflector cover 28 and is fixed to the inside of the reflector cover 28. The heating element 26 is arranged penetrating a through hole 27*b* made at a side reflector-plate 27*a* of the reflector 27, and both the ends of the heating element 26 are fitted to sockets 30 which are provided at outer surfaces of the side reflector-plates 27*a*, so that the heating element 26 is fixed so as to be fed electrical supply through the sockets 30. A metal plate which forms the reflector 27 is made from, for example, an aluminum plate having a purity of 99% or more and a reflectance ratio of the heat ray at the reflection surface is 95% or more.

Figure 10:
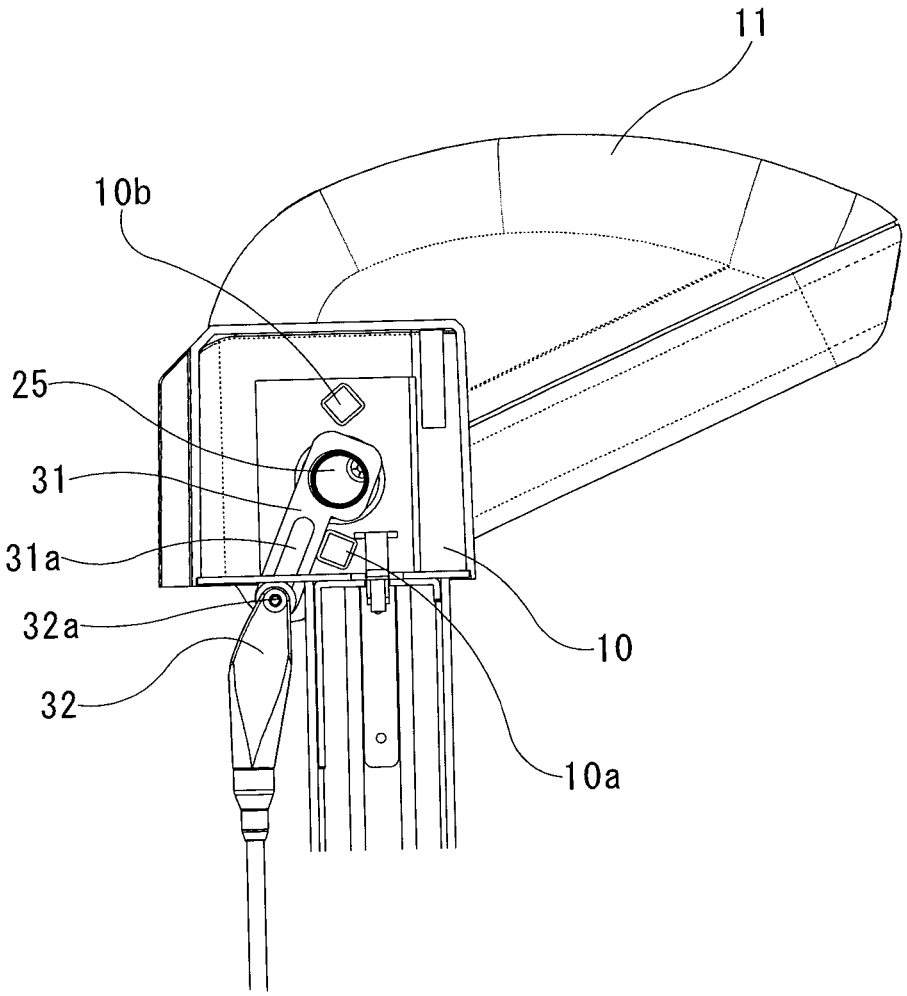
FIG. 10 is a sectional view taken along the line A-A in FIG. 7, showing a mechanism for rotating the heater between the heating position and a folding position.

In the infant incubator 1, as shown in FIG. 10, as a mechanism for driving rotation of the heater 11, a linkage mechanism is employed to have a link member 31 which is connected to and rotatable as a unit with the first supporting-shaft 25; and a rod 32 which is engaged with the link member 31 and extended substantially vertically. In this mechanism for driving rotation, by rotating the link member 31 back and forth at the predetermined extent along with the up and down movement of the rod 32, the rotation stay 29 is rotated back and forth at the predetermined extent as a unit with the first supporting-shaft 25, so that the heater 11 which is attached to the rotation stay 29 is rotated. By rotating the first supporting-shaft 25 at the predetermined angle extent using the linkage mechanism, the posture of the heater 11 can be changed between the folding position and the heating position.

Specifically, the linkage mechanism for rotating the first supporting-shaft 25 will be described below. In the link member 31 which is formed as a unit with the first supporting-shaft 25, as shown in FIG. 10, a slot hole 31*a* is formed. To the slot hole 31*a*, an engage pin 32*a* which is provided at an upper end of the rod 32 is engaged. The rod 32 is held by the second guide-post 10 so as to move back and forth substantially vertically in a state in which the rod 32 is pushed by a spring (not illustrated) along the back-and-forth direction. In the upper end portion of the second guide-post 10, a stopper 10*a* for the heating position and a stopper 10*b* for the folding position are mounted for determining the rotation extent of the link member 31.

In this linkage mechanism, as shown in FIG. 10, when the rod 32 is moved down, since the link member 31 is rotated around the first supporting-shaft 25 by the engage pin 32*a* of the rod 32 engaging the slot hole 31*a*, and held in a state in which the link member 31 is in contact with the stopper 10*a* for the heating position, so that the position of the heater 11 is set to the heating position. On the other hand, when the rod 32 is moved up, since the engage pin 32*a* is moved up, the link member 31 is rotated clockwise so as to be held in a state being in contact with the stopper 10*b* for the folding position, so that the position of the heater 11 is set to the folding position. Therefore, the angle of the rotation stay 29 which is rotated by the linkage mechanism is determined between the heating position and the folding position.

Figure 11:
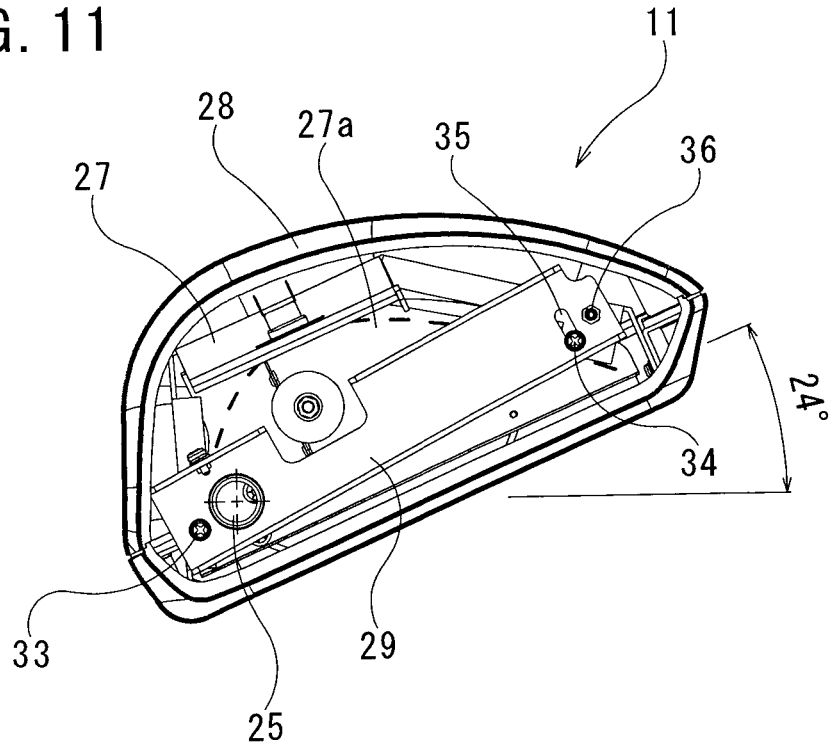
FIG. 11 is a sectional view taken along the line B-B in FIG. 7, showing a mechanism for further rotating the heater at the heating position.

The rotation stay 29 which is fixed to the first supporting-shaft 25 which is rotated by the linkage mechanism is provided, as shown in FIG. 8 and FIG. 9, between the reflector 27 and the reflector cover 28 inside the heater 11. The reflector 27 and the reflector cover 28 are connected by the second supporting-shaft 33 provided at the rotation stay 29 with each other, and attached to the rotation stay 29 as a unit rotatably around the second supporting-shaft 33 and capable of being held at a predetermined angle position. As shown in FIG. 11, the second supporting-shaft 33 is provided at the other position than the first supporting-shaft 25. A relative rotation angle of the reflector 27 and the reflector cover 28 around the second supporting-shaft 33 with respect to the rotation stay 29 is determined in a predetermined extent by an engagement of an engage pin 34 fixed to the side reflector-plate 27*a* of the reflector 27 with a slot hole 35 formed at the rotation stay 29.

The rotation stay 29 is, as shown in FIG. 11, provided with a ball plunger 36 which protrudes toward the side reflector-plate 27*a* of the reflector 27. On the other hand, with the side reflector-plate 27*a* of the reflector 27, as shown in FIG. 9, a first engage hole 37*a* and a second engage hole 37*b* are provided so as to be engaged with a top end of the ball plunger 36. In a state in which the heater 11 is normal heating position, when the ball plunger 36 provided at the reflector 27 is engaged with the first engage hole 37*a* of the rotation stay 29, a lower surface of the reflector cover 28 is maintained to be inclined at 24° with respect to the horizontal direction. In this heating position, if the reflector 27 is rotated around the second supporting-shaft 33 with respect to the rotation stay 29 so as to engage the ball plunger 36 with the second engage hole 37*b*, the lower surface of the reflector cover 28 is maintained to be inclined at 28° with respect to the horizontal direction.

That is to say, by the linkage mechanism utilizing the elevation of the rod 32, the heater 11 is set to the heating position by being rotated around the first supporting-shaft 25 along with the rotation of the rotation stay 29. Moreover, by further rotation with respect to the rotation stay 29, the heater 11 is slightly (in this embodiment, 4°) rotated from the heating position, so that the emission direction of the heat ray can be changed. The rotation of the heater 11 with respect to the rotation stay 29 can be operated by hands.

Figure 12:
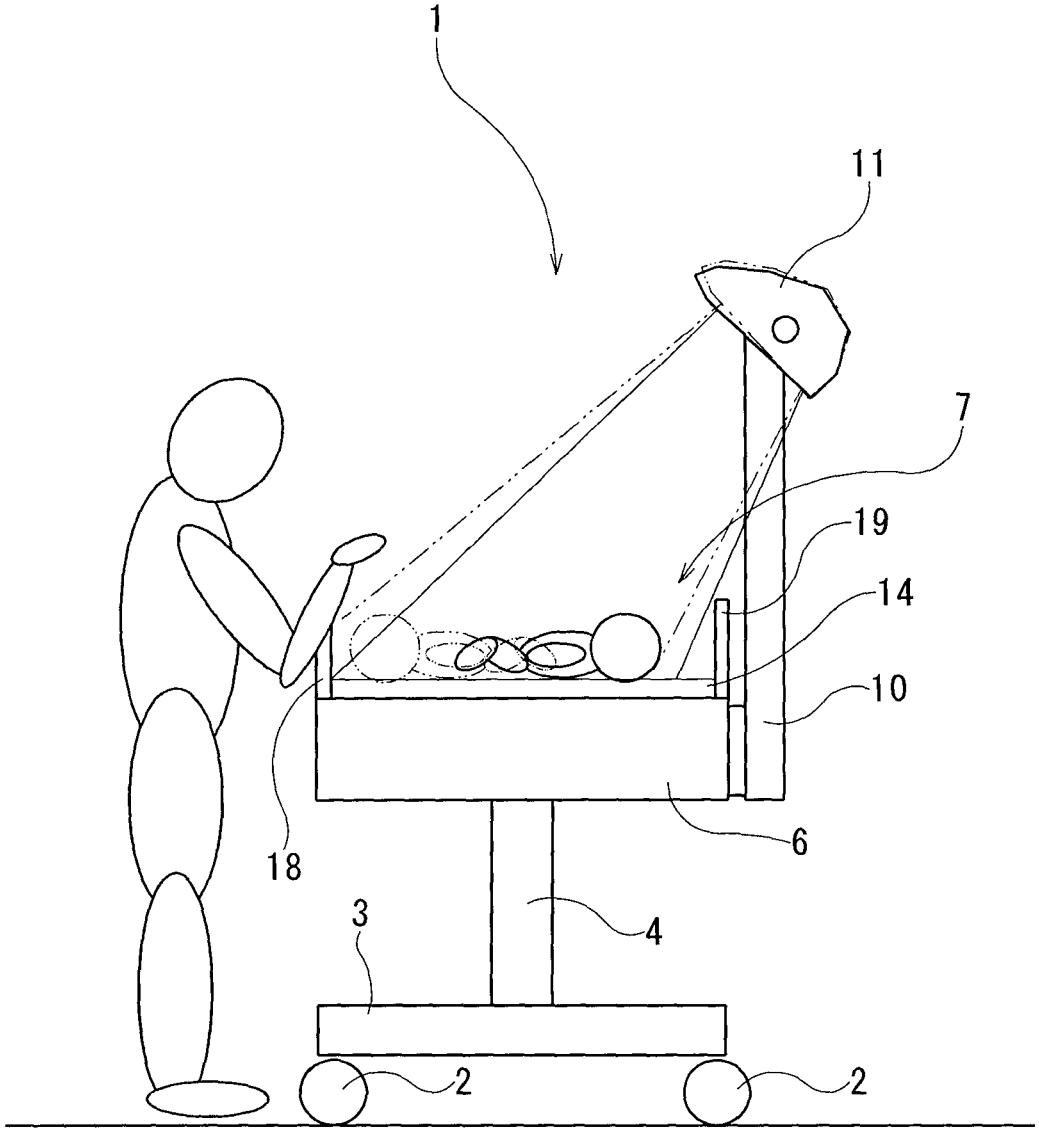
FIG. 12 is a schematic view showing a state in which an emission direction of the heat ray of the heater is adjusted in the infant incubator.

In the infant incubator 1 structured as above, in a state in which the canopy 12 is moved up as shown in FIG. 5, the heat ray of the heater 11 in the heating position can be supplied to the infant chamber 7 from above. When the canopy 12 is moved down and up between the state in which the hood 8 is closed by moving down the canopy 12 and the state in which the top of the infant chamber 7 is open by moving up the canopy 12, in order to prevent the heater 11 from interrupting the movement of the heater 11, the heater 11 is not arranged immediately above the infant chamber 7 (i.e., the bed 14), but outside the head-side treatment-door 19, and can be moved away from a moving line of the canopy 12 and be folded. Therefore, as shown in FIG. 12, the heat ray from the heater 11 is emitted obliquely to the bed 14 of the infant chamber 7. Furthermore, in this infant incubator 1, by moving the heater 11 away from immediately above the infant chamber 7, treatments or radiographic examinations for the infant can be operated without being prevented by the heater 11.

The emission area of the heat ray from the heater 11 is set so as to make the upper surface of the bed 14 even temperature environment, not to heat the operator, and not to be broaden largely from the upper surface of the bed 14, as shown by continuous lines in FIG. 12. Usually, as shown by the continuous lines in FIG. 12, since the infant is laid on substantially the center of the bed 14 so that the head of the infant is positioned near the head-side treatment-door 19, the infant is included in the emission area of the heat ray from the heater 11 and is maintained in a appropriate temperature. However, as shown in two-dot chain lines in FIG. 12, if the infant is laid so that the head is positioned near the foot-side treatment-door 18 and the infant is approached to the foot-side treatment-door 18, a part of the body of the infant may be deviated from the emission area of the heat ray.

In this infant incubator 1, in order to heat the infant laid an edge of the bed 14, it is considered to change the angle of the heater 11 so as to adjust the emission area of the heat ray. However, the angle of the heater 11 is changed by the linkage mechanism which links to the up-and-down movement of the rod 32. Therefore, if this linkage mechanism is employed, the angle of the heater 11 is determined between the heating position and the folding position, so that it is hard by the linkage mechanism to shift the emission area of the heat ray from the usual heating position to the foot-side treatment-door 18 side. On the other hand, according to the infant incubator 1 of the present invention, the other rotation mechanism is provided than the linkage mechanism for change the heater 11 between the heating position and the folding position. Therefore, the heater 11 can be further rotated by the rotation mechanism, so that the emission area of the heat ray can be shifted to the foot-side treatment-door 18 side as shown by the two-dot chain line if FIG. 12. As a result, according to the infant incubator 1, the emission area of the heat ray can be adjusted so as to include the whole body of the infant wherever the infant is laid on the bed 14.

The present invention is not limited to the above-described embodiments and various modifications may be made without departing from the scope of the present invention.

What is claimed is:

1. An infant incubator comprising:

a bed configured to receive an infant;

a lift-post provided vertically at a side of the bed;

a first supporting-shaft which is disposed obliquely above the bed at an upper end of the lift-post, extends substantially horizontally, and is rotatable back and forth at a predetermined extent around an axis;

a rotation stay which is fixed to the first supporting-shaft and is rotated with the first supporting-shaft;

a second supporting-shaft which is provided with the rotation stay and substantially parallel to the first supporting-shaft; and a heater which is disposed obliquely above the bed, attached to the rotation stay rotatably back and forth at a predetermined extent around the second supporting-shaft, and configured to emit a heat ray obliquely to an upper surface of the bed, and wherein by rotating the rotation stay back and forth around the first supporting-shaft at the predetermined extent, the heater is moved along with the rotation stay, so that a position of the heater can be varied between a heating position for emitting the heat ray and a folding position for moving away from above the bed;

at the heating position, by rotating the heater back and forth around the second supporting-shaft with respect to the rotation stay at the predetermined extent, an emission angle of the heat ray from the heater is further varied.

2. The infant incubator according to claim 1, further comprising:

a link member which is connected to and rotated with the first supporting-shaft; and a rod which is engaged with the link member and extends substantially vertically, wherein by rotating the link member back and forth at the predetermined extent along with up- and down motion of the rod, the rotation stay is rotated back and forth with the first supporting-shaft at the predetermined extent.

* * * * *